US011612249B2

(12) United States Patent
Hu et al.

(10) Patent No.: US 11,612,249 B2
(45) Date of Patent: Mar. 28, 2023

(54) CHAIR CHASSIS AND CHAIR

(71) Applicant: Comfort Office Furniture Co., Ltd Guangdong, Guangzhou (CN)

(72) Inventors: Guoqiang Hu, Guangzhou (CN); Min Zhang, Guangzhou (CN)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 0 days.

(21) Appl. No.: 17/540,441

(22) Filed: Dec. 2, 2021

(65) Prior Publication Data

US 2022/0378210 A1 Dec. 1, 2022

(30) Foreign Application Priority Data

May 27, 2021 (CN) ..... 202110582976.4

(51) Int. Cl.
*A47C 1/032* (2006.01)
*A47C 7/44* (2006.01)
*A47C 7/00* (2006.01)

(52) U.S. Cl.
CPC ..... *A47C 7/44* (2013.01); *A47C 7/004* (2013.01)

(58) Field of Classification Search
CPC ..... A47C 7/44; A47C 1/03261
USPC ..... 297/285, 296, 298, 300.1–301.7
See application file for complete search history.

(56) References Cited

U.S. PATENT DOCUMENTS 3,351,379 A * 11/1967 Street ..... A47C 7/402 297/358
3,434,756 A * 3/1969 Walkinshaw ..... A47C 1/026 297/301.7
4,384,741 A * 5/1983 Flum ..... A47C 1/026 297/300.5 X
5,282,670 A * 2/1994 Karsten ..... A47C 7/443 297/301.6
5,354,120 A * 10/1994 Volkle ..... A47C 1/03255 297/300.1
5,397,111 A * 3/1995 Knopp ..... A47C 3/30 188/300
5,511,852 A * 4/1996 Kusiak ..... A47C 7/402 297/301.4

(Continued)

OTHER PUBLICATIONS

European search report and European search opinion dated Jun. 30, 2022; EP 21214062.8.

*Primary Examiner* — Rodney B White
(74) *Attorney, Agent, or Firm* — IPro, PLLC

(57) ABSTRACT

A chair chassis includes: a base, provided with an accommodation chamber; a backrest support; a memory stopper, disposed on the backrest support, wherein the memory stopper is provided with a first arc surface facing the base; a locking slider, slidably disposed in the accommodation chamber of the base, wherein the locking slider is provided with a second arc surface disposed opposite to the first arc surface, and a side of the locking slider is provided with a first rack; a first elastic member; and an elastic slider, slidably disposed in the accommodation chamber of the base, wherein one end of the elastic slider is provided with a second rack, wherein the second rack is meshable with the first rack. Accordingly, the chair chassis according to the embodiments of the present disclosure achieves reclination memory adjustment of a backrest of the chair.

20 Claims, 10 Drawing Sheets

(56) References Cited

U.S. PATENT DOCUMENTS 5,810,439 A * 9/1998 Roslund, Jr. ..... A47C 1/03266 297/300.4
5,971,481 A 10/1999 Emmenegger et al.
6,033,020 A * 3/2000 Ito ..... A47C 7/444 297/328
6,053,574 A * 4/2000 Opsvik ..... A47C 3/026 297/303.2
6,250,715 B1 * 6/2001 Caruso ..... A47C 1/03 297/300.8
6,588,843 B1 * 7/2003 Ebenstein ..... A47C 1/031 297/301.4
6,712,428 B2 * 3/2004 Moreschi ..... A47C 1/03272 297/300.5 X
6,921,134 B1 * 7/2005 Hong ..... A47C 1/03238 297/301.7
6,945,603 B2 * 9/2005 Elzenbeck ..... A47C 1/03233 297/300.5 X
6,957,862 B2 * 10/2005 Chen ..... A47C 1/026 297/300.1 X
7,014,262 B2 * 3/2006 Rossetto ..... A47C 1/03238 297/301.7
7,048,335 B2 * 5/2006 Norman ..... A47C 7/46 297/300.1 X
7,264,312 B1 * 9/2007 Wang ..... A47C 1/023 297/383
7,293,832 B2 * 11/2007 Huang ..... A47C 1/03238 297/301.7
7,530,637 B1 * 5/2009 Wu ..... A47C 1/03266 297/300.5 X
7,784,870 B2 * 8/2010 Machael ..... A47C 1/03272 297/301.7
7,815,257 B2 * 10/2010 Costaglia ..... A47C 1/03255 297/303.5
7,866,749 B2 * 1/2011 Costaglia ..... A47C 1/03238 297/301.7
8,251,449 B2 * 8/2012 Wu ..... A47C 1/026 297/301.4
8,414,075 B2 * 4/2013 Ko ..... A47C 1/03266 297/302.6
8,556,345 B2 * 10/2013 Huang ..... A47C 1/03255 297/303.4
8,979,200 B2 * 3/2015 Chen ..... A47C 3/026 297/302.7
9,386,858 B2 * 7/2016 Chen ..... A47C 1/024
9,402,479 B1 * 8/2016 Lin ..... A47C 1/0355
10,231,546 B2 * 3/2019 Loew ..... A47C 3/22
10,383,448 B1 * 8/2019 VerBeek ..... A47C 1/03255
10,653,249 B2 * 5/2020 Schmitz ..... A47C 31/126
10,682,271 B2 * 6/2020 Lin ..... A47C 7/5068
11,166,569 B2 * 11/2021 Schmitz ..... A47C 31/126
2004/0195883 A1 * 10/2004 Vrijlandt ..... A47C 1/03266 297/300.5 X
2007/0040433 A1 * 2/2007 Huang ..... A47C 1/03255 297/325
2013/0069408 A1 * 3/2013 Chen ..... A47C 1/03205 297/337
2016/0327071 A1 * 11/2016 Hosan ..... F16F 9/56

* cited by examiner

CHAIR CHASSIS AND CHAIR

CROSS REFERENCE TO RELATED APPLICATIONS

The present disclosure claims priority to Chinese Patent Application No. 202110582976.4, filed with the Chinese Patent Office on May 27, 2021, titled "CHAIR CHASSIS AND CHAIR", the entire contents of which are incorporated herein by reference.

TECHNICAL FIELD

Embodiments of the present disclosure relate to the technical field of chair backrest adjustment, and in particular, relate to a chair chassis and a chair.

BACKGROUND

Chairs are necessities in people's daily life and working. For accommodation of different needs and different habits of different users, in a conventional chair, supports by the backrest against a human body at different angles are achieved by adjusting and fixing an inclination angle of pitching and reclination of the backrest. However, due to structural limitation of the backrest adjustment mechanism, it is only possible that the backrests of most of the chairs are adjusted to a desired angle and then fixed, and fail to move with movement of the back of the human body. Therefore, comfort of the chair is poor.

SUMMARY

In view of the above problem, embodiments of the present disclosure provide a chair chassis and a chair, which achieve reclination memory adjustment of a backrest of the chair.

According to one aspect of the embodiments of the present disclosure, a chair chassis is provided. The chair chassis is configured to adjust a backrest of a chair. The chair chassis includes: a base, provided with an accommodation chamber; a backrest support, wherein one end of the backrest support is configured to be connected to the backrest of the chair, and the other end of the backrest support is rotatably connected to the base, and the backrest support is elastically restorable; a memory stopper, disposed on the backrest support, wherein the memory stopper is provided with a first arc surface facing the base; a locking slider, slidably disposed in the accommodation chamber of the base, wherein the locking slider is provided with a second arc surface disposed opposite to the first arc surface, wherein the second arc surface is configured to support and limit recline rotation of the first arc surface such that reclination of the backrest support is limited, and a side of the locking slider is provided with a first rack; a first elastic member, connected between the locking slider and the base, and configured to supply a restoration elastic force for sliding towards the memory stopper to the locking slider; and an elastic slider, slidably disposed in the accommodation chamber of the base, wherein one end of the elastic slider is provided with a second rack, wherein the second rack is meshable with the first rack, and configured to limit and lock the locking slider.

In an optional embodiment, the chair chassis further includes: a second elastic member, connected between the elastic slider and the base, and configured to supply an elastic force for sliding away from the locking slider to the elastic slider; an active slider, slidably disposed in the accommodation chamber of the base, wherein a side of the active slider is abuttable against one end of the elastic slider to limit sliding of the elastic slider; and a third elastic member, connected between the active slider and the base, and configured to supply an elastic force for sliding towards the elastic slider to the active slider.

In an optional embodiment, the active slider is provided with a first inclined surface, and the elastic slider is provided with a second inclined surface, wherein in the case that the active slider slides towards the elastic slider under action of the third elastic member, the first inclined surface and the second inclined surface slide relative to each other such that the elastic slider slides towards the locking slider and the second rack is meshed with the first rack.

In an optional embodiment, a first pull cord is connected to the active slider; wherein in the case that the first pull cord is pulled, the active slider slides such that the elastic slider is separated from the locking slider.

In an optional embodiment, two sides of the backrest support are each provided with a connection arm rotatably connected to the base, and the chair chassis further includes: a pitch block, disposed on an inner side of the connection arm; a restraining slider, slidably disposed in the accommodation chamber of the base, wherein the restraining slider is mated with the pitch block, and configured to limit pitch rotation of the backrest support.

In an optional embodiment, the pitch block is provided with a restraining surface, wherein the restraining surface is configured to be abutted against the restraining slider to limit pitch rotation of the backrest support.

In an optional embodiment, the chair chassis further includes: a fourth elastic member, disposed on the base, wherein one end of the fourth elastic member is connected to the restraining slider, and configured to drive the restraining slider to slide to be separated from the pitch block; and a fifth elastic member, connected between the other end of the fourth elastic member and the base, and configured to supply an elastic force for sliding towards the pitch block to the restraining slider.

In an optional embodiment, a second pull cord is connected to the fourth elastic member, wherein in the case that the second pull cord is pulled, the restraining slider slides such that the restraining slider is separated from the pitch block.

In an optional embodiment, a top of the locking slider is covered with a cover plate, wherein the cover plate is fixedly connected to threads of the base.

In an optional embodiment, the chair chassis further includes an elastic strip, wherein one end of the elastic strip is clamped onto the base, and the other end of the elastic strip is clamped onto the backrest support, wherein the base is provided with a support structure configured to support the elastic strip.

In an optional embodiment, the backrest support rotates relative to the base about the rotation shaft to adjust reclination and pitching of the backrest.

According to another aspect of the embodiments of the present disclosure, a chair is provided. The chair includes the chair chassis.

In an optional embodiment, the chair further includes a cushion support, wherein the cushion support is disposed on the chair chassis, and the cushion support is provided with a handle, wherein the handle is configured to control and adjust the chair chassis.

The backrest support rotates relative to the base about a rotation shaft to adjust reclination and pitching of the backrest. In the case that the second rack on the elastic slider is meshed with the first rack on the locking slider, the locking slider is limited and locked, and in this case, the memory stopper is capable of undergoing pitch rotation. In the case that the memory stopper undergoes recline rotation about the rotation shaft, reaches the first arc surface and is abutted against the second arc surface, since the locking slider is limited and locked, the memory stopper fails to continue the recline rotation. In this way, the reclination memory limitation of the backrest support is achieved. In addition, by meshing-based locking and disengagement-based unlocking between the second rack on the elastic slider and the first rack on the locking slider, the locking slider slides to any position and is then locked. In this way, an angle of the reclination memory limitation may be unlimitedly adjusted, and a user may adjust any reclination angle for memory and locking according to actual needs, thereby improving comfort of the user. During use, since the backrest support is elastically restorable, within the angle for memory limitation of the backrest support, the backrest of the chair may be automatically abutted against the back of a human body and rotates for adjustment accordingly with movement of the back of the human body, such that the backrest of the chair is tightly attached to the back of the human body and provides a sufficient support for the user. Therefore, the design is more humanized, and sitting comfort is further improved.

The above description only summarizes the technical solutions of the present disclosure. Specific embodiments of the present disclosure are described hereinafter to better and clearer understand the technical solutions of the present disclosure, to practice the technical solutions based on the disclosure of the specification and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

Figure 1:
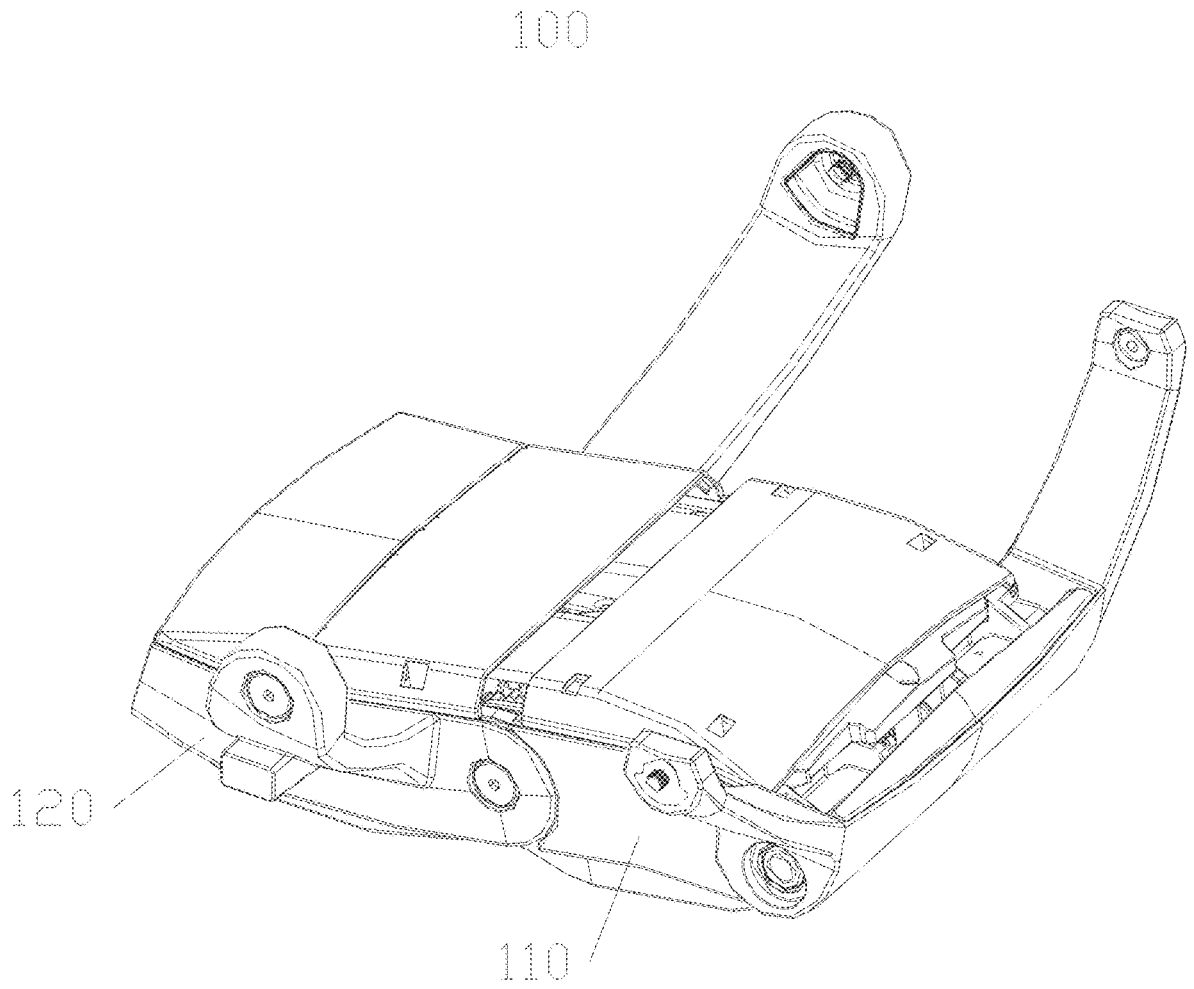
FIG. 1 is a schematic structural view of a chair chassis according to an embodiment of the present disclosure.

Reference numerals in the embodiments and denotations thereof:

100—Chair chassis, 110—base, 111—accommodation chamber, 120—backrest support, 121—connection arm, 130—memory stopper, 131—first arc surface, 140—locking slider, 141— second arc surface, 142—cover plate, 143—first rack, 150—first elastic member, 160—elastic slider, 161—second rack, 162—second inclined surface, 170—pitch block, 171—restraining surface, 180— restraining slider, 190—second elastic member, 200—active slider, 210—third elastic member, 220— fourth elastic member, 221—fifth elastic member, 230—first pull cord, 240—second pull cord, 250—first inclined surface, 300—elastic strip, 310—support structure, 500—rotation shaft, 1—chair, 10—cushion support, and 11—handle.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

According to one aspect of the embodiments of the present disclosure, a chair chassis and a chair are provided, which achieve reclination memory adjustment of a backrest of the chair.

Referring to FIG. 1 to FIG. 5, a structure of a chair chassis and a structure of an internal adjustment mechanism thereof are illustrated, and side structures of engagement and disengagement between a memory stopper and a locking slider are illustrated.

As illustrated in the drawings, the chair chassis 100 includes: a base 110, a backrest support 120, a memory stopper 130, a locking slider 140, a first elastic member 150, and an elastic slider 160. The base 110 is internally provided with an accommodation chamber 111. One end of the backrest support 120 is connected to a backrest of a chair, and the other end of the backrest support 120 is rotatably connected to the base 110. The backrest support 120 may be automatically pitch restored by an elastic sheet or a torsion spring. The memory stopper 130 is disposed on the backrest support 120, and the memory stopper 130 is provided with a first arc surface 131 facing the base. The locking slider 140 is slidably disposed in the accommodation chamber 111 of the base 110, and the locking slider 140 is provided with a second arc surface 141 disposed opposite to the first arc surface 131. The second arc surface 141 is configured to support and limit recline rotation of the first arc surface 131, such that reclination of the backrest support 120 is limited. The first elastic member 150 is connected between the locking slider 140 and the base 110, and configured to supply a restoration elastic force for sliding towards the memory stopper 130 to the locking slider 140. The elastic slider 160 is slidably disposed in the accommodation chamber 111 of the base 110. One end of the elastic slider 160 is provided with a second rack 161. A side of the locking slider 140 is provided with a first rack 143. The second rack 161 on the elastic slider 160 is meshable with the first rack 143 on the locking slider 140, and configured to limit and lock the locking slider 140.

Figure 3:
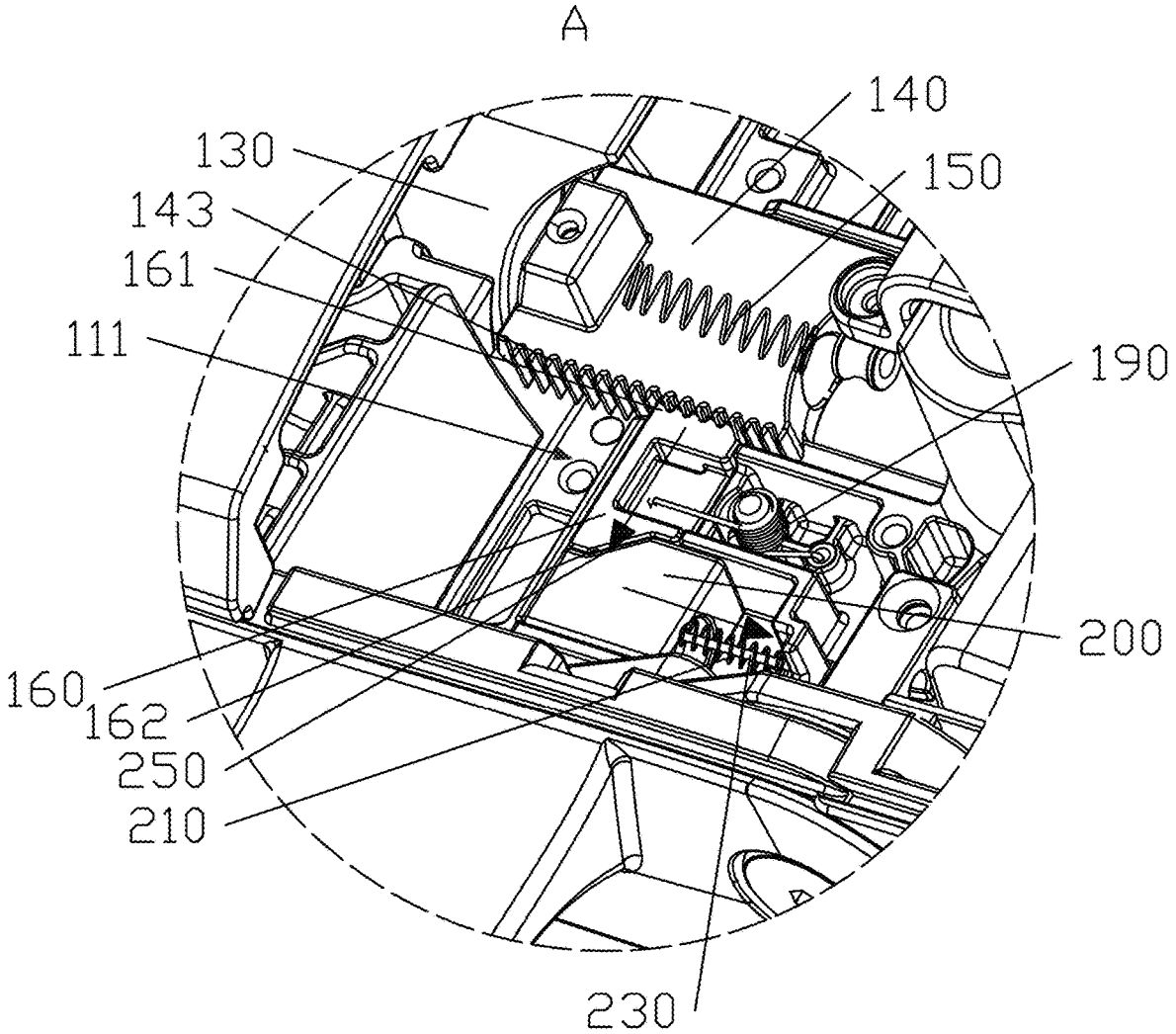
FIG. 3 is a schematic partial enlarged view of part A in FIG. 2.
Figure 4:
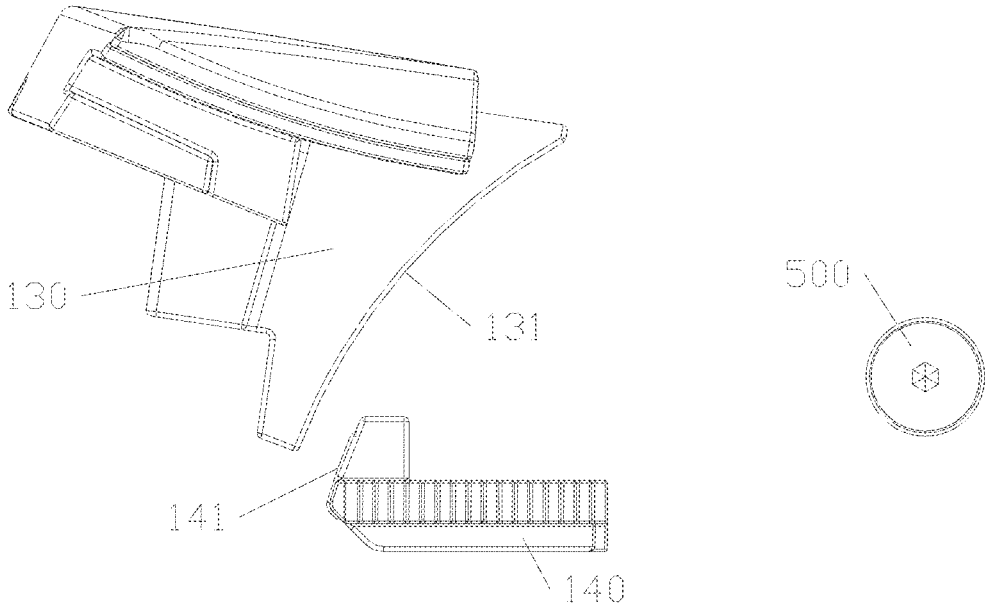
FIG. 4 is a schematic view of a side structure of disengagement between a locking slider and a memory stopper in the chair chassis according to an embodiment of the present disclosure.
Figure 5:
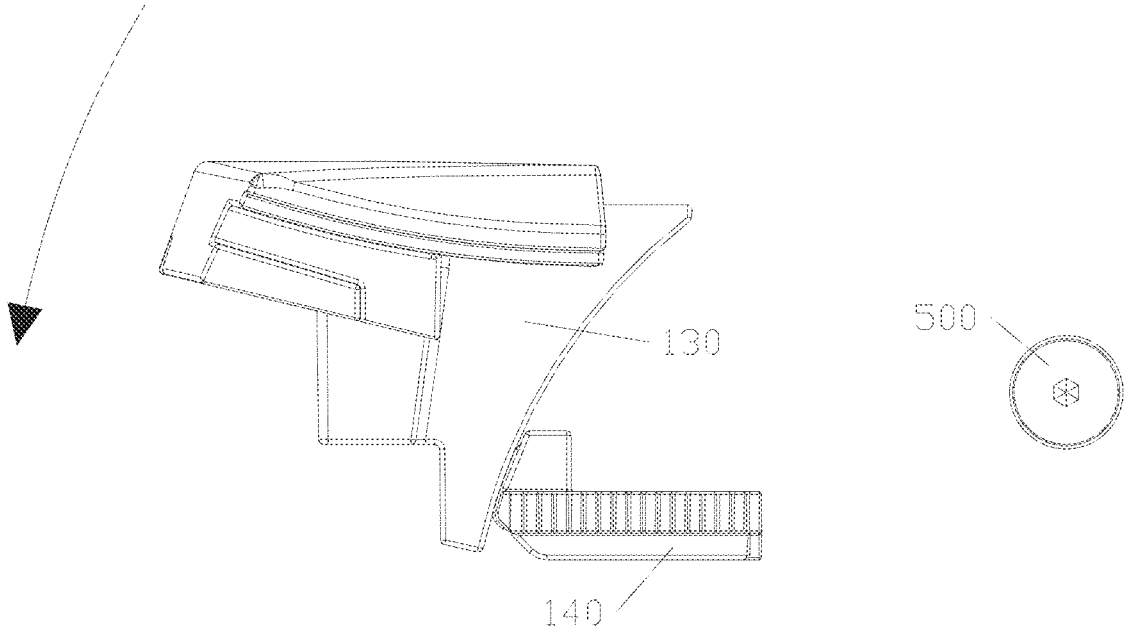
FIG. 5 is a schematic view of a side structure of abutting and engagement between the memory stopper upon recline rotation about a rotation shaft and the locking slider in FIG. 4.

Still referring to FIG. 3 to FIG. 5, the backrest support 120 rotates relative to the base 110 about the rotation shaft 500 to adjust reclination and pitching of the backrest. In the case that the second rack 161 on the elastic slider 160 is meshed with the first rack 143 on the locking slider 140, the locking slider 140 is limited and locked, and in this case, the memory stopper 130 is capable of undergoing pitch rotation (for example, the state illustrated in FIG. 4). In the case that the memory stopper 130 undergoes recline rotation about the rotation shaft 500, reaches the first arc surface 131 and is abutted against the second arc surface 141 (for example, the state illustrated in FIG. 5), since the locking slider 140 is limited and locked, the memory stopper 130 fails to continue the recline rotation. In this way, the reclination memory limitation of the backrest support 120 is achieved. In addition, by meshing-based locking and disengagement-based unlocking between the second rack 161 on the elastic slider 160 and the first rack 143 on the locking slider 140, the locking slider 140 slides to any position and is then locked. In this way, an angle of the reclination memory limitation may be unlimitedly adjusted, and a user may adjust any reclination angle for memory and locking according to actual needs, thereby improving comfort of the user. During use, since the backrest support is elastically restorable, within the angle for memory limitation of the backrest support, the backrest of the chair may be automatically abutted against the back of a human body and rotates for adjustment accordingly with movement of the back of the human body, such that the backrest of the chair is tightly attached to the back of the human body and provides a sufficient support for the user. Therefore, the design is more humanized, and sitting comfort is further improved.

Figure 2:
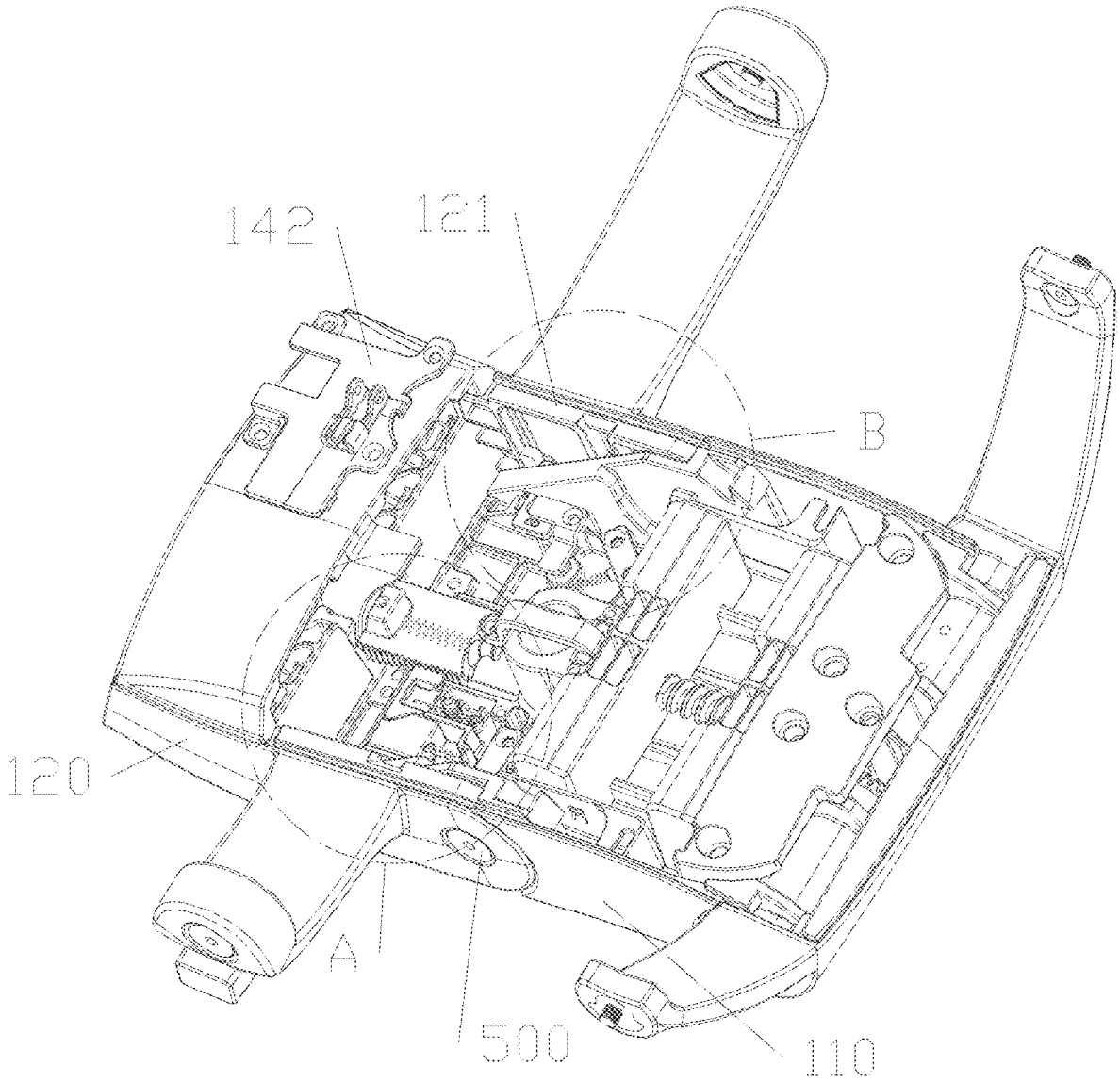
FIG. 2 is a schematic view of an internal structure of the chair chassis according to an embodiment of the present disclosure.

Still referring to FIG. 2 and FIG. 3, in specific embodiments, to limit a slide trajectory of the locking slider 140, a top of the locking slider 140 is covered with a cover plate 142. The cover plate 142 is fixedly connected to threads of the base 110.

Further, to improve usability of reclination limitation of the chair, the present disclosure further provides another embodiment. Specifically, still referring to FIG. 3, in some embodiments, the chair chassis may further include: a second elastic member 190, an active slider 200, and a third elastic member 210. The second elastic member 190 (for example, the torsion spring as illustrated in FIG. 3) is connected between the elastic slider 160 and the base, and configured to supply an elastic force for sliding away from the locking slider 140 to the elastic slider 160. The active slider 200 is slidably disposed in the accommodation chamber 111 of the base. A side of the active slider 200 is abuttable against one end of the elastic slider 160 to limit sliding of the elastic slider 160. The third elastic member 210 is connected between the active slider 200 and the base, and configured to supply an elastic force for sliding towards the elastic slider 160 to the active slider 200.

In the case that the active slider 200 overcomes the elastic force of the third elastic member 210 and slides (a slide direction is as indicated by the arrow marked on the active slider 200 in FIG. 3), the active slider 200 is not abutted against the elastic slider 160, such that the elastic slider 160 slides (a slide direction is as indicated by the arrow marked on the elastic slider 160 in FIG. 3) towards the active slider 200 under action of the second elastic member 190, such that the second rack 161 on the elastic slider 160 is separated from the first rack 143 on the locking slider 140. In this way, the locking slider 140 is unlocked, and the locking slider slides under action of the first elastic member 150.

Further, to improve operating efficiency between the active slider and the elastic slider, the present disclosure further provides another embodiment. Still referring to FIG. 3, in the embodiment, the active slider 200 is provided with a first inclined surface 250, and the elastic slider 160 is provided with a second inclined surface 162. In the case that the active slider 200 slides towards the elastic slider 160 under action of the third elastic member 210, the first inclined surface 250 of the active slider 200 and the second inclined surface 162 of the elastic slider 160 slide relative to each other, such that the elastic slider 160 slides towards the locking slider 140, and the second rack 161 on the elastic slider 160 is meshed with the first rack 143 on the locking slider 140. By configuring the first inclined surface 250 on the active slider 200 and the second inclined surface 162 on the elastic slider 160, in the case that the active slider 200 slides towards the elastic slider 160 under action of the third elastic member 210, the first inclined surface 250 and the second inclined surface 162 slide relative to each other, and the first inclined surface 250 of the active slider 200 supplies a pushing force to the second inclined surface 162 of the elastic slider 160, such that the elastic slider 160 is driven to slide towards the locking slider 140. Configuration of the inclined surfaces optimizes a transmission structure between the active slider 200 and the elastic slider 160, and improves a transmission efficiency.

Still referring to FIG. 3, in some embodiments, a first pull cord is connected to the active slider 200. In response to the first pull cord 230 being pulled, the active slider 200 slides (a slide direction is as indicated by the arrow marked on the active slider 200), such that the elastic slider 160 is separated from the locking slider 140.

By configuring the first pull cord 230, the user is capable of pulling the first pull cord 230 via the exterior of the chair or via a handle on the chair, and thus controlling limiting locking and unlocking of the locking slider 140. In this way, the reclination memory angle of the backrest of the chair is adjusted and locked.

The chair chassis according to the embodiments of the present disclosure further includes a pitch block and a restraining slider, configured to limit pitch rotation of the backrest of the chair. Specifically, referring to FIG. 6 and FIG. 7, structures of the pitch block and the restraining block in the chair chassis according to the embodiments of the present disclosure are schematically illustrated. In some embodiments, two sides of the backrest support 120 may be each provided with a connection arm 121 rotatably connected to the base 110, and the chair chassis further includes a pitch block 170 and a restraining slider 180. The pitch block 170 is disposed on an inner side of the connection arm 121, the restraining slider 180 is slidably disposed in the accommodation chamber 111 of the base 110, and the restraining slider 180 is mateable with the pitch block 170, and configured to limit pitch rotation of the backrest support 120.

By cooperation between the pitch block 170 and the restraining slider 180, the backrest support 120 is limited in response to pitch rotation of the backrest support 120 to a fixed position, and thus the backrest support 120 is prevented from over-pitched and causing damages to the lumbar of the human body.

Figure 8:
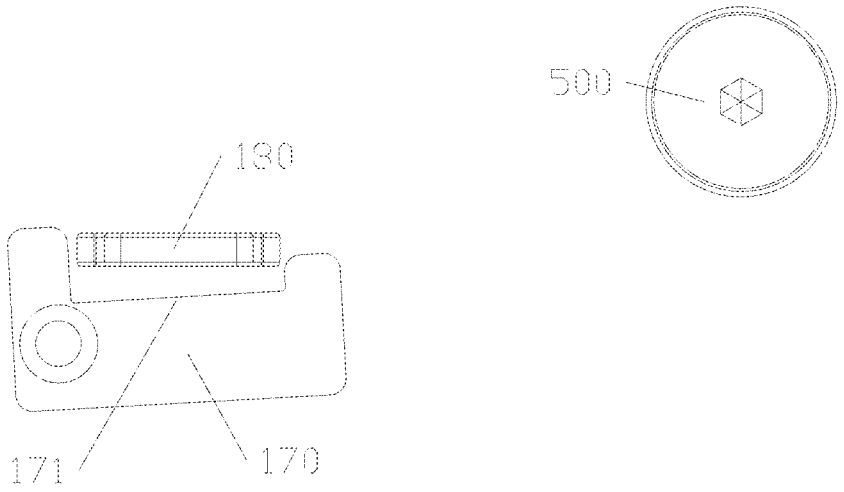
FIG. 8 is a schematic view of a side structure of disengagement between the pitch block and the locking slider in the chair chassis according to an embodiment of the present disclosure.
Figure 9:
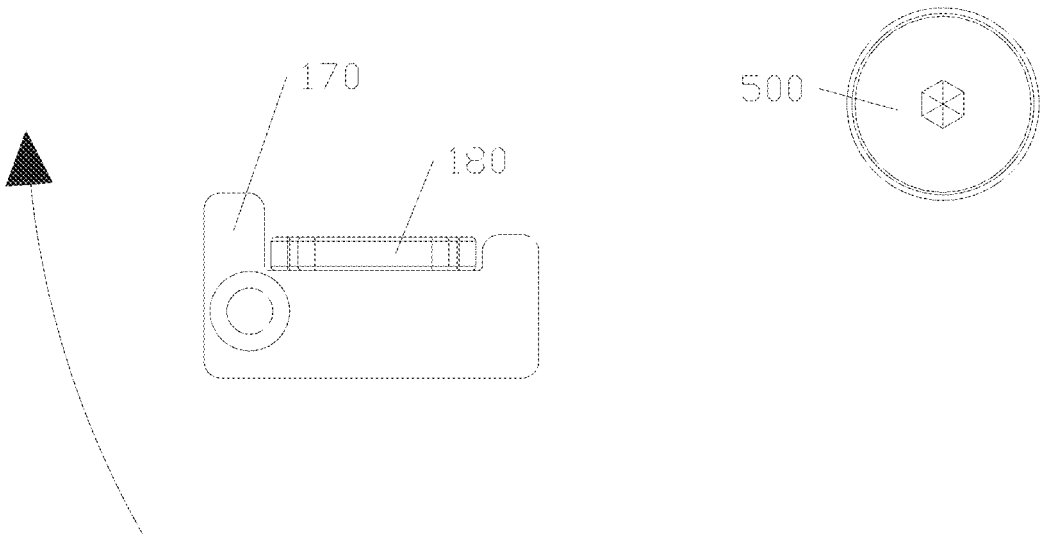
FIG. 9 is a schematic view of a side structure of abutting and engagement between the pitch block in FIG. 8 upon pitch rotation along the rotation shaft and a restraining slider.

Referring to FIG. 8 and FIG. 9, side structures of engagement and disengagement between the restraining slider 180 and the pitch block 170 in the chair chassis according to an embodiment of the present disclosure are illustrated. In some embodiments, the pitch block 170 may be provided with a restraining surface 171 facing towards the restraining slider 180. The restraining surface 171 is configured to be abutted against the restraining slider 180 to limit pitch rotation of the backrest support 120.

Still referring to FIG. 8 and FIG. 9, in response to recline rotation of the backrest support, the restraining surface 171 of the pitch block 170 is separated from the restraining slider 180 (for example, the state as illustrated in FIG. 8). In this case, in response to pitch rotation of the backrest support about the rotation shaft 500, the restraining surface 171 of the pitch block 170 is abutted against the restraining block 180, the restraining block 180 limits continuous pitch rotation of the pitch block 170, such that the limiting locking of pitching of the backrest support is locked.

Figure 6:
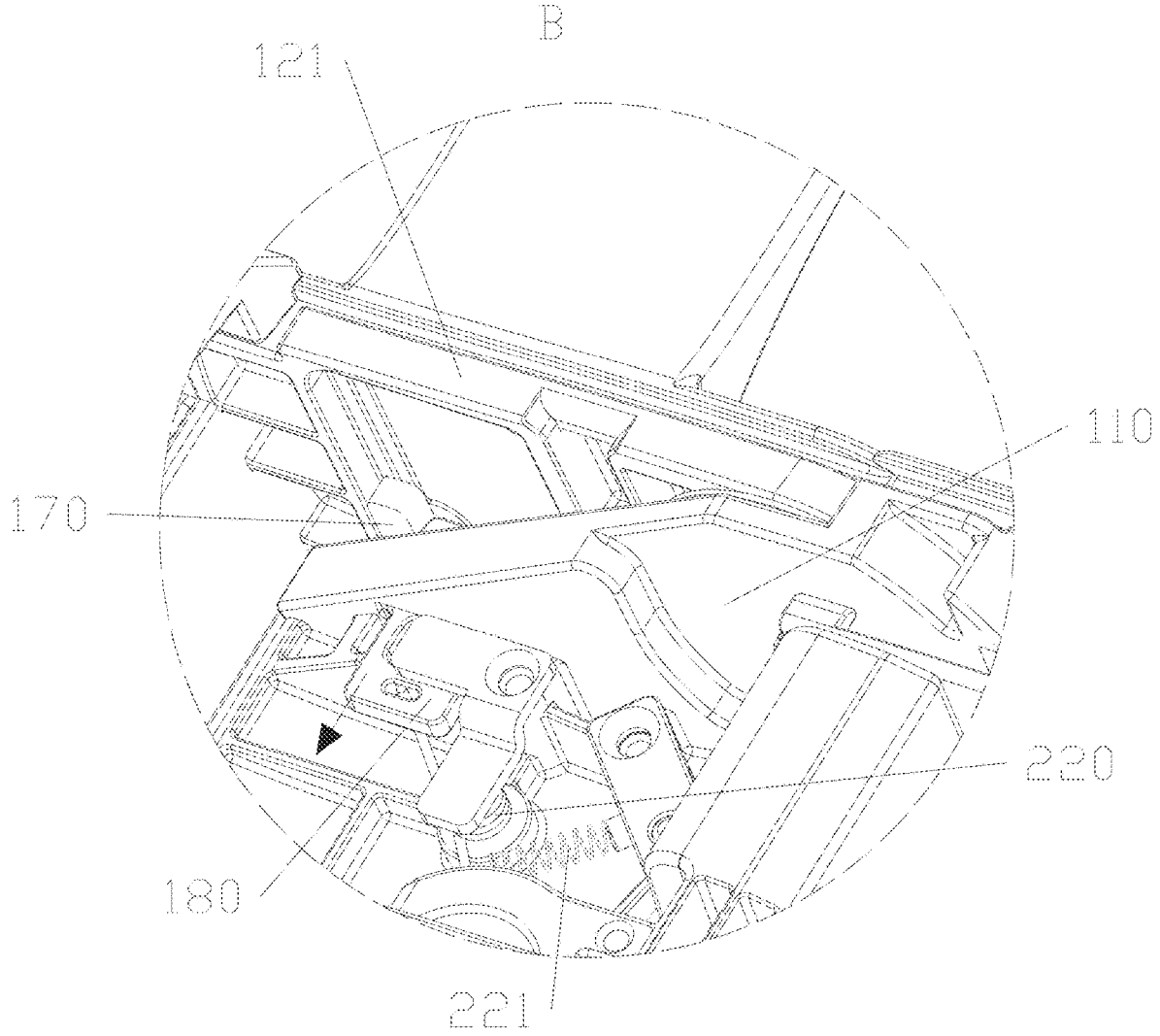
FIG. 6 is a schematic partial enlarged view of part B in FIG. 2.
Figure 7:
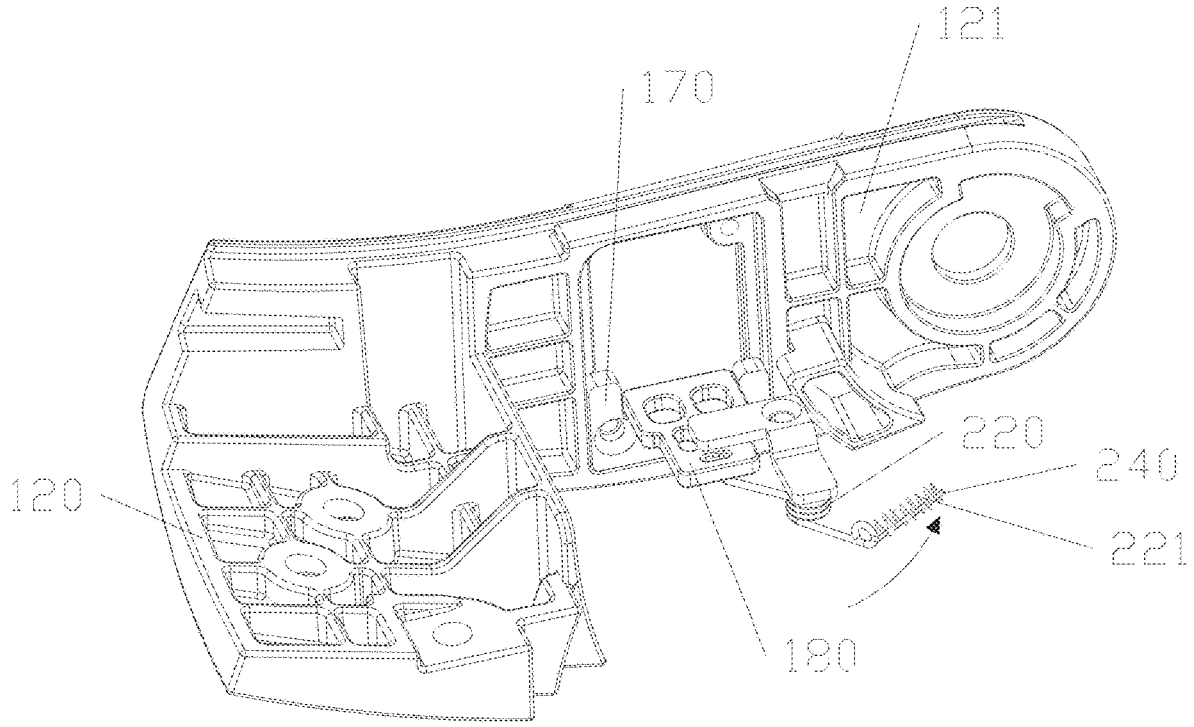
FIG. 7 is a schematic structural view of a pitch block and the locking slider in the chair chassis according to an embodiment of the present disclosure.

Still referring to FIG. 6 and FIG. 7, in some embodiments, the chair chassis may further include a fourth elastic member 220 (for example, a torsion spring as illustrated in FIG. 7) and a fifth elastic member 221 (for example, a spring as illustrated in FIG. 7). The fourth elastic member 220 is disposed on the base, and one end of the fourth elastic member 220 is rotatably connected to the restraining slider 180 to drive the restraining slider 180 to slide to disengage from the pitch block 170. The fifth elastic member 221 is connected between the other end of the fourth elastic member 220 and the base, and configured to supply an elastic force for sliding towards the elastic slider 170 to the restraining slider 180. Still referring to FIG. 8, in the case that the fourth elastic member 220 rotates (a rotation direction of the fourth elastic member 220 is as indicated by the arrow marked in FIG. 8) and drives the restraining block 180 to slide inwardly, the restraining slider 180 is separated from the pitch block 170, such that the pitch block 170 may continue pitch rotation thereof. In the case that the fourth elastic member 220 suffers from no external force, an elastic restoration force of the fifth elastic member 221 causes the fourth elastic member 220 to reversely rotate and drive the restraining block 180 to slide outwardly, such that the restraining slider 180 may be in limiting fit with the pitch block 170 again.

Still referring to FIG. 8, in some embodiments, a second pull cord 240 may be connected to the fourth elastic member 220. In response to the second pull cord 240 being pulled, the restraining block 180 slides, such that the restraining block 180 is separated from the pitch block 170.

By configuring the second pull cord 240, the user is capable of pulling the second pull cord 240 via the exterior of the chair or via a handle on the chair, and thus controlling engagement and disengagement between the restraining slider 180 and the pitch block 170. In this way, limitation and release of limitation of pitching of the backrest of the chair are achieved.

Figure 10:
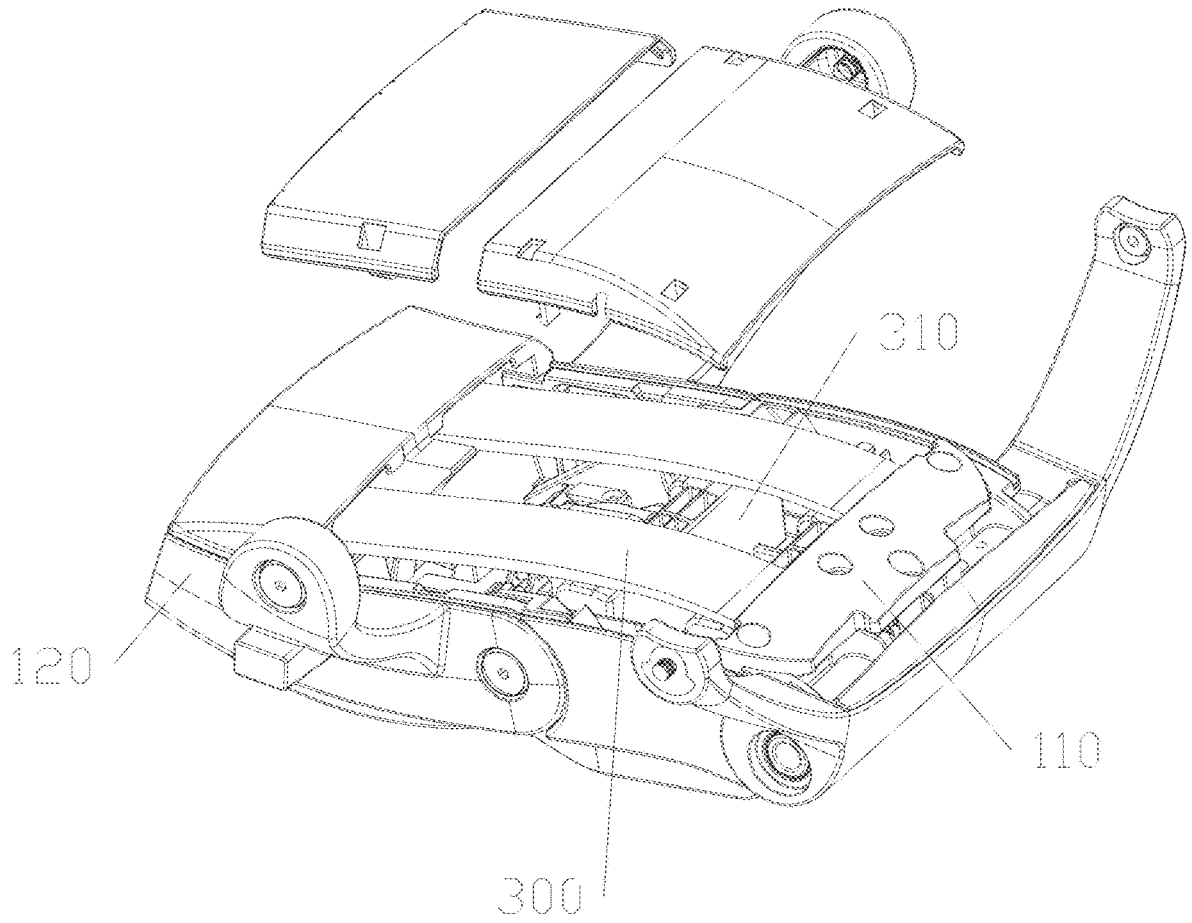
FIG. 10 is a schematic structural view of an elastic strip in the chair chassis according to an embodiment of the present disclosure.

To ensure stability of an automatic pitch restoration structure of the backrest support, the present disclosure further provides an embodiment. Specifically, referring to FIG. 10, in some embodiments, the chair chassis may further include an elastic strip 300. One end of the elastic strip 300 is clamped onto the base 110, and the other end of the elastic strip 300 is clamped onto the backrest support 120. The base 110 is provided with a support structure 310 configured to support the elastic strip 300.

By configuring the elastic strip 300 and the support structure 310, in response to recline rotation of the backrest support 120, the elastic strip 300 is pressed such that the elastic strip 300 is subject to an elastic deformation. In the case that the backrest of the chair does not suffer an external force, the elastic strip 300 restores from the deformation to drive the backrest support 120 to undergo pitch rotation restoration.

A person skilled in the art shall understand that the illustrations in the drawings are merely examples, and in other embodiments, automatic pitch restoration of the backrest support may also be achieved by configuring a torsion spring on the rotation shaft to which the backrest support and the base are connected.

Figure 11:
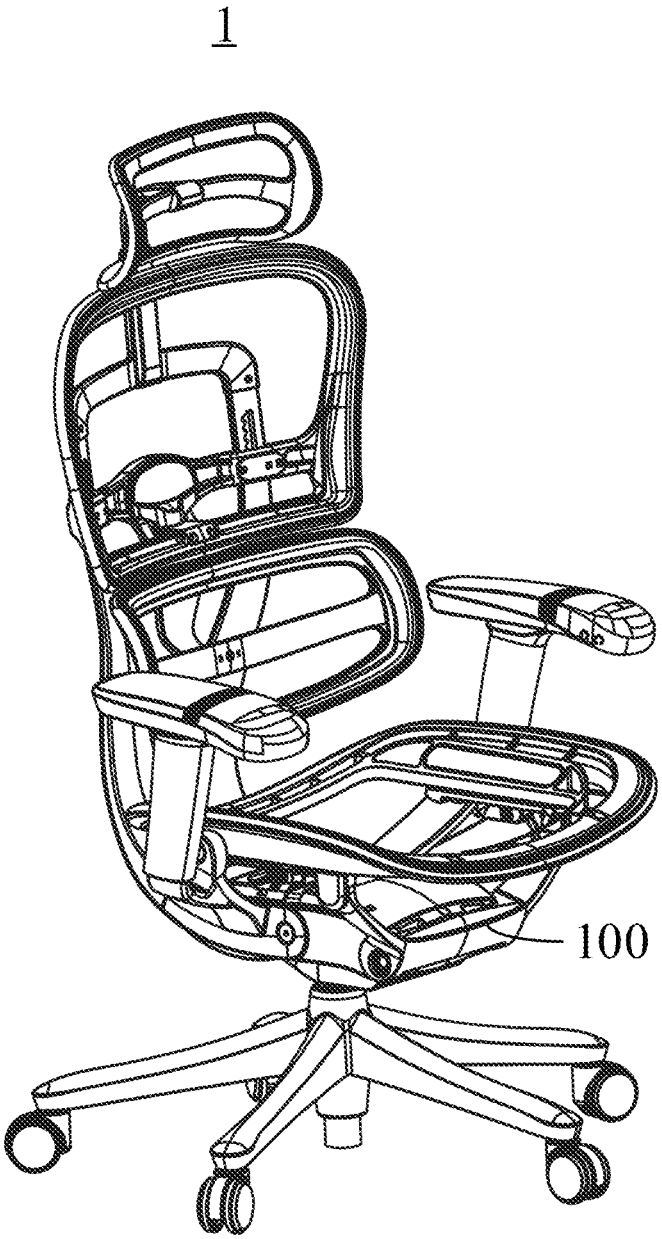
FIG. 11 is a schematic structural view of a chair according to an embodiment of the present disclosure.

As illustrated in FIG. 11, according to another aspect of the embodiments of the present disclosure, a chair 1 is provided. The chair 1 includes the chair chassis 100 as described in the above embodiments.

Figure 12:
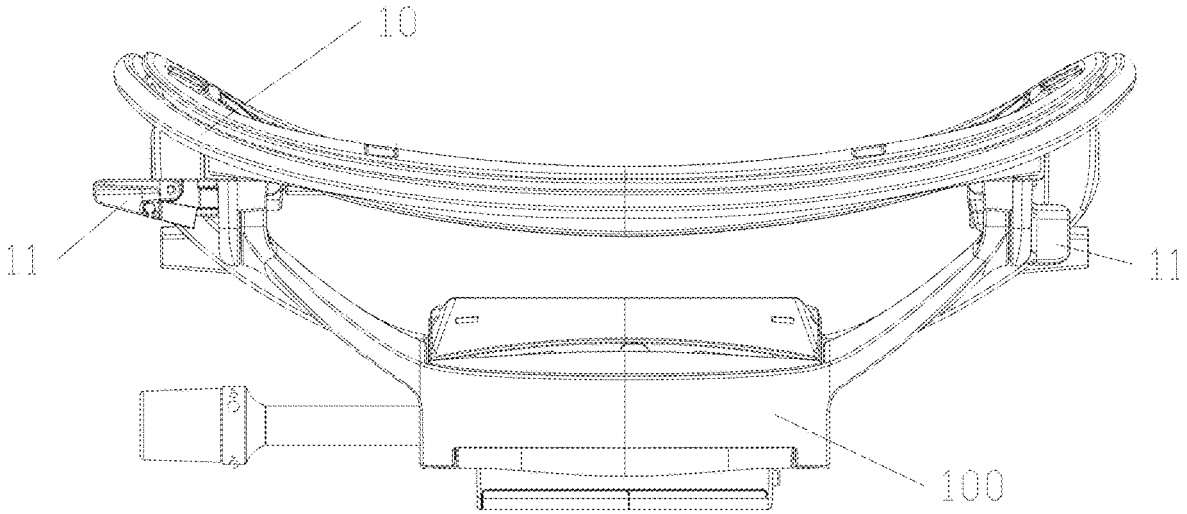
FIG. 12 is a schematic structural view of a cushion support and a chair chassis in a chair according to an embodiment of the present disclosure.

Referring to FIG. 12, a schematic structure of a cushion support in a chair according to an embodiment of the present disclosure is illustrated.

As illustrated in FIG. 12, the chair may further include a cushion support 10. The cushion support 10 is disposed on the chair chassis 100, and the cushion support 10 is provided with a handle 11. The handle 11 is configured to control and adjust the chair chassis 100.

Still referring to FIG. 12, in the specific embodiment as illustrated in FIG. 12, two sides of the cushion support 10 are each provided with the handle 11. The handle 11 may be configured to pull the active slider and the restraining slider using a pull cord, such that locking and unlocking of the reclination memory of the backrest of the chair, and locking and unlocking of pitching of the backrest of the chair are achieved. In this way, the user is capable of conveniently adjusting reclination memory limitation of the backrest of the chair.

It should be noted that unless otherwise specified, the technical terms and scientific terms used in the present disclosure shall express general meanings that may be understood by a person skilled in the art.

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "more" or "a plurality of" signifies at least two, unless otherwise specified.

In the description of the embodiments of the present disclosure, it should be noted that unless otherwise specified and defined, the terms "mounted," "coupled," "connected," "fixed," and derivative forms thereof shall be understood in a broad sense, which, for example, may be understood as fixed connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In the description of the embodiments of the present disclosure, unless otherwise specified or defined, by defining that a first feature is arranged "above," or "below," or "beneath" a second feature, it means that the first feature is in direct contact with the second feature, or the first feature is in indirect contact with the second feature via an intermediate medium. In addition, by defining that a first feature is arranged "over," "above," and "under" a second feature, it means that the first feature is rightly over the second feature or is obliquely above the second feature, or the horizontal height of the first feature is greater than that of the second feature. In addition, by defining that a first feature is arranged "under," or "below," or "beneath" a second feature, it means that the first feature is rightly under the second feature or is obliquely below the second feature, or the horizontal height of the first feature is less than that of the second feature.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A chair chassis, configured to adjust a backrest of a chair, the chair chassis comprising:

a base, provided with an accommodation chamber;

a backrest support, wherein a a first end of the backrest support is configured to be connected to the backrest of the chair, and a second end of the backrest support is rotatably connected to the base, and the backrest support is elastically restorable;

a memory stopper, disposed on the backrest support, wherein the memory stopper is provided with a first arc surface facing the base;

a locking slider, slidably disposed in the accommodation chamber of the base, wherein the locking slider is provided with a second arc surface disposed opposite to the first arc surface, wherein the second arc surface is configured to support and limit recline rotation of the first arc surface such that reclination of the backrest support is limited, and a side of the locking slider is provided with a first rack;

a first elastic member, connected between the locking slider and the base, and configured to supply a restoration elastic force for sliding towards the memory stopper to the locking slider; and an elastic slider, slidably disposed in the accommodation chamber of the base, wherein a first end of the elastic slider is provided with a second rack, wherein the second rack is meshable with the first rack, and configured to limit and lock the locking slider.

2. The chair chassis according to claim 1, further comprising:

a second elastic member, connected between the elastic slider and the base, and configured to supply an elastic force for sliding away from the locking slider to the elastic slider;

an active slider, slidably disposed in the accommodation chamber of the base, wherein a side of the active slider is abutted against a second end of the elastic slider to limit sliding of the elastic slider; and a third elastic member, connected between the active slider and the base, and configured to supply an elastic force for sliding towards the elastic slider to the active slider.

3. The chair chassis according to claim 2, wherein the active slider is provided with a first inclined surface, and the elastic slider is provided with a second inclined surface, wherein when the active slider slides towards the elastic slider under action of the third elastic member, the first inclined surface and the second inclined surface slide relative to each other such that the elastic slider slides towards the locking slider and the second rack is meshed with the first rack.

4. The chair chassis according to claim 3, wherein a first pull cord is connected to the active slider, wherein when the first pull cord is pulled, the active slider slides such that the elastic slider is separated from the locking slider.

5. The chair chassis according to claim 1, wherein two sides of the backrest support are each provided with a connection arm rotatably connected to the base, and the chair chassis further comprises:

a pitch block, disposed on an inner side of the connection arm;

a restraining slider, slidably disposed in the accommodation chamber of the base, wherein the restraining slider is mated with the pitch block, and configured to limit pitch rotation of the backrest support.

6. The chair chassis according to claim 5, wherein the pitch block is provided with a restraining surface, wherein the restraining surface is configured to be abutted against the restraining slider to limit pitch rotation of the backrest support.

7. The chair chassis according to claim 5, further comprising:

a fourth elastic member, disposed on the base, wherein a first end of the fourth elastic member is connected to the restraining slider, and configured to drive the restraining slider to slide to be separated from the pitch block; and a fifth elastic member, connected between a second end of the fourth elastic member and the base, and configured to supply an elastic force for sliding towards the pitch block to the restraining slider.

8. The chair chassis according to claim 7, wherein a second pull cord is connected to the fourth elastic member, wherein in the case that when the second pull cord is pulled, the restraining slider slides such that the restraining slider is separated from the pitch block.

9. The chair chassis according to claim 1, wherein a top of the locking slider is covered with a cover plate, wherein the cover plate is fixedly connected to threads of the base.

10. The chair chassis according to claim 1, wherein the chair chassis further comprises an elastic strip, wherein a first end of the elastic strip is clamped onto the base, and a second end of the elastic strip is clamped onto the backrest support, wherein the base is provided with a support structure configured to support the elastic strip.

11. The chair chassis according to claim 1, wherein the backrest support rotates relative to the base about the rotation shaft to adjust reclination and pitching of the backrest.

12. A chair, comprising a chair chassis, wherein the chair chassis is configured to adjust a backrest of a chair, wherein the chair chassis comprises:

a base, provided with an accommodation chamber;

a backrest support, wherein a first end of the backrest support is configured to be connected to the backrest of the chair, and a second end of the backrest support is rotatably connected to the base, and the backrest support is elastically restorable;

a memory stopper, disposed on the backrest support, wherein the memory stopper is provided with a first arc surface facing the base;

a locking slider, slidably disposed in the accommodation chamber of the base, wherein the locking slider is provided with a second arc surface disposed opposite to the first arc surface, wherein the second arc surface is configured to support and limit recline rotation of the first arc surface such that reclination of the backrest support is limited, and a side of the locking slider is provided with a first rack;

a first elastic member, connected between the locking slider and the base, and configured to supply a restoration elastic force for sliding towards the memory stopper to the locking slider; and an elastic slider, slidably disposed in the accommodation chamber of the base, wherein a first end of the elastic slider is provided with a second rack, wherein the second rack is meshable with the first rack, and configured to limit and lock the locking slider.

13. The chair according to claim 12, further comprising a cushion support, wherein the cushion support is disposed on the chair chassis, and the cushion support is provided with a handle, wherein the handle is configured to control and adjust the chair chassis.

14. The chair according to claim 12, wherein the chair chassis further comprises:

a second elastic member, connected between the elastic slider and the base, and configured to supply an elastic force for sliding away from the locking slider to the elastic slider;

an active slider, slidably disposed in the accommodation chamber of the base, wherein a side of the active slider is abutted against a second end of the elastic slider to limit sliding of the elastic slider; and a third elastic member, connected between the active slider and the base, and configured to supply an elastic force for sliding towards the elastic slider to the active slider.

15. The chair according to claim 14, wherein the active slider is provided with a first inclined surface, and the elastic slider is provided with a second inclined surface, wherein when the active slider slides towards the elastic slider under action of the third elastic member, the first inclined surface and the second inclined surface slide relative to each other such that the elastic slider slides towards the locking slider and the second rack is meshed with the first rack.

16. The chair according to claim 15, wherein a first pull cord is connected to the active slider, wherein when the first pull cord is pulled, the active slider slides such that the elastic slider is separated from the locking slider.

17. The chair according to claim 12, wherein two sides of the backrest support are each provided with a connection arm rotatably connected to the base, and the chair chassis further comprises:

a pitch block, disposed on an inner side of the connection arm;

a restraining slider, slidably disposed in the accommodation chamber of the base, wherein the restraining slider is mated with the pitch block, and configured to limit pitch rotation of the backrest support.

18. The chair according to claim 17, wherein the pitch block is provided with a restraining surface, wherein the restraining surface is configured to be abutted against the restraining slider to limit pitch rotation of the backrest support.

19. The chair according to claim 17, further comprising:

a fourth elastic member, disposed on the base, wherein a first end of the fourth elastic member is connected to the restraining slider, and configured to drive the restraining slider to slide to be separated from the pitch block; and a fifth elastic member, connected between a second end of the fourth elastic member and the base, and configured to supply an elastic force for sliding towards the pitch block to the restraining slider.

20. The chair according to claim 19, wherein a second pull cord is connected to the fourth elastic member, wherein when the second pull cord is pulled, the restraining slider slides such that the restraining slider is separated from the pitch block.

* * * * *